US005170315A

United States Patent [19]

Simon

[11] Patent Number: 5,170,315

[45] Date of Patent: Dec. 8, 1992

[54] ELECTROSTATIC SPRAY GUN

[75] Inventor: Georg Simon, Altstätten, Switzerland

[73] Assignee: Wagner International AG, Switzerland

[21] Appl. No.: 712,435

[22] Filed: Jun. 10, 1991

[30] Foreign Application Priority Data

Aug. 27, 1990 [DE] Fed. Rep. of Germany ..... 4027078

[51] Int. Cl.[5] ..... B05B 5/025

[52] U.S. Cl. ..... 361/225; 361/228; 239/690; 307/109

[58] Field of Search ..... 361/225, 226-227, 361/228, 230, 235; 363/59, 60, 61; 307/109, 110; 239/690

[56] References Cited

U.S. PATENT DOCUMENTS

| | | | |
|---|---|---|---|
| 3,599,038 | 8/1971 | Skidmore | 361/228 |
| 3,938,739 | 2/1976 | Bertilsson et al. | 239/705 |
| 4,033,506 | 7/1977 | Braun | 361/228 |
| 4,165,022 | 8/1979 | Bentley et al. | 361/235 |
| 4,196,465 | 4/1980 | Buschor | 361/228 |
| 4,266,262 | 5/1981 | Haase, Jr. | 361/228 |
| 4,287,552 | 9/1981 | Wagner et al. | 361/228 |
| 4,290,091 | 9/1981 | Malcolm | 361/228 |
| 4,323,947 | 4/1982 | Huber | 361/228 |
| 4,441,656 | 4/1984 | Huber | 239/708 |
| 4,554,622 | 11/1985 | Mommsen et al. | 363/61 |
| 4,572,437 | 2/1986 | Huber et al. | 239/703 |
| 4,651,932 | 3/1987 | Huber et al. | 239/707 |
| 4,737,887 | 4/1988 | Thome | 361/228 |
| 4,750,676 | 6/1988 | Huber et al. | 239/705 |
| 4,752,034 | 6/1988 | Kuhn et al. | 239/690 |
| 4,775,105 | 10/1988 | Reese | 239/704 |
| 4,916,571 | 4/1990 | Stäheli | 361/227 |
| 5,067,434 | 11/1991 | Thür et al. | 361/228 |

FOREIGN PATENT DOCUMENTS 2522991 9/1983 France .

*Primary Examiner*—Jeffrey A. Gaffin

[57] ABSTRACT

In an electrostatic spray gun, particularly a hand spray gun, for coating workpieces with liquid or powdery coating material, the integrated or attached high-voltage cascade comprises a carrier plate of sintered ceramic that is printed with interconnects and capacitor surfaces. The diodes of the high-voltage cascade can also be printed onto a corresponding carrier plate.

20 Claims, 3 Drawing Sheets

ELECTROSTATIC SPRAY GUN

BACKGROUND OF THE INVENTION

The invention is directed to an electrostatic spray gun, particularly to a hand spray gun, for coating materials with liquid or powdery coating material comprising a built-in or attached multistage high voltage cascade of capacitors and diodes that represents a voltage multiplier.

It has been known for many years to integrate the multi-stage voltage multiplier (high-voltage cascade) composed of capacitors and diodes with the spray gun, for example to build it into the gun grip or into the gun barrel. As a result of a skilled arrangement and selection of the capacitors and diodes of the cascade, the dimensions and the weight of the high-voltage cascade have been successfully reduced in recent years, this being of critical significance, of course, particularly in hand spray guns. A further reduction in space and weight, however, now probably has a limit placed on it by the dimensions of the required capacitor and diode components without achieving a preferred reduction in space and weight.

SUMMARY OF THE INVENTION

It is therefore an object of the present invention to fashion a voltage multiplier intended for integration into or attachment to an electrostatic spray gun such that its dimensions and its weight can still be significantly diminished. This object is achieved by providing a high voltage cascade which comprises a carrier plate of material having a high dielectric constant upon which interconnects and the capacitor surfaces on plate surfaces lying opposite one another are printed, vapor deposited or laminated in a matrix. The printed, vapor deposited or laminated carrier plate is cast out with an insulating compound. Additionally, an extension beyond the capacitor matrix may be provided for the application of resistors and/or other electronic components.

A second carrier plate may be provided with a diode matrix corresponding with the capacitor matrix of the first carrier plate printed, vapor deposited or laminated thereon. The two carrier plates with the capacitor matrix and the diode matrix would be laid on top of one another and then cast out with insulating material.

BRIEF DESCRIPTION OF THE DRAWINGS

Embodiments of the invention are shown by way of example in the drawings.

DETAILED DESCRIPTION OF THE PREFERRED EMBODIMENTS

Figure 1:
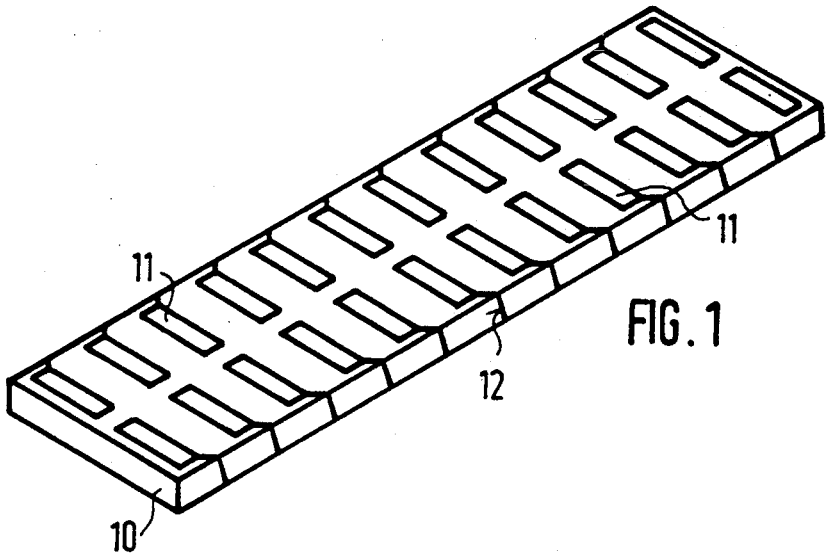
FIG. 1 is a perspective view of a carrier plate having printed capacitors.

FIG. 1 shows a carrier plate 10 having a rectangular extent that is composed of a high dielectric material such as sintered ceramic. A plurality of corresponding capacitor surfaces 11 are printed onto the upper and lower surface of this carrier plate 10, in a matrix, namely in the form of two rows of capacitors lying opposite one another, similar to the arrangement of the capacitors of a standard high-voltage cascade. The electrical input and output for the capacitors is accomplished by means of interconnects 12 that are likewise printed on the carrier plate 10.

Figure 2:
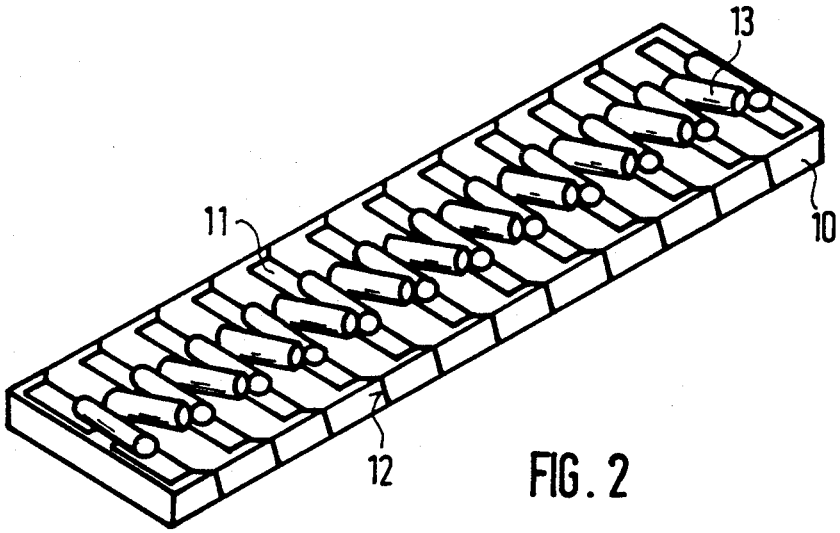
FIG. 2 is a perspective view of the printed circuit board of FIG. 1 having diodes soldered thereon, shown in the same view.

FIG. 2 shows an embodiment of the overall high-voltage cascade whereby the required diodes 13 are applied onto the carrier plate 10 having the capacitors 11 and interconnects 12 of FIG. 1, being correspondingly connected to the capacitors by soldering. For protecting the high-voltage cascade, this assembly is then cast out or covered with an insulating compound, for example, synthetic resin.

The circuit diagram of this high-voltage cascade of FIG. 2 thereby completely corresponds to that of a high-voltage cascade constructed upon employment of traditional capacitors, so that a specific explanation thereof is superfluous. The dimensions as well as the weight of the high-voltage cascade of FIG. 2, however, are significantly lower than in traditionally constructed high-voltage cascades.

Figure 3:
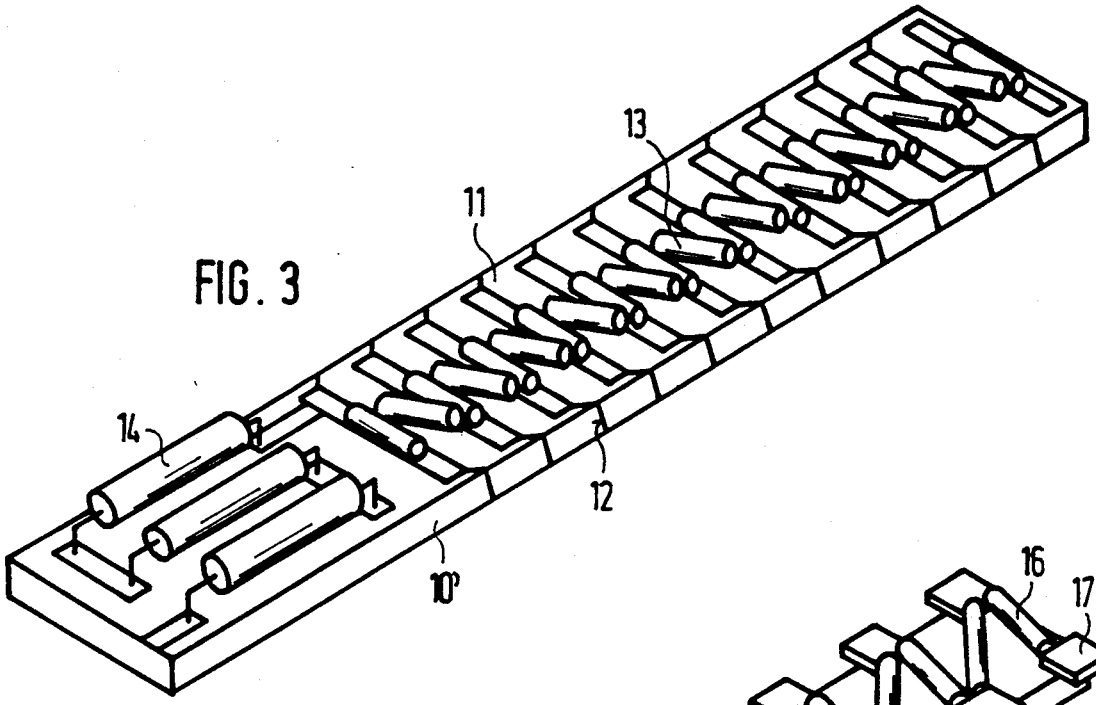
FIG. 3 is a perspective view of an embodiment modified in comparison to FIG. 2 having additionally applied resistors.

FIG. 3 shows a modification of the high-voltage cascade of FIG. 2. The modification is that the carrier plate 10 of FIG. 3 has been lengthened at one end 10' and protective resistors 14 of a type standard and necessary in electrostatic spray guns, between the high-voltage output of the cascade and the charging electrode, are arranged on the lengthened end 10'.

Figure 4:
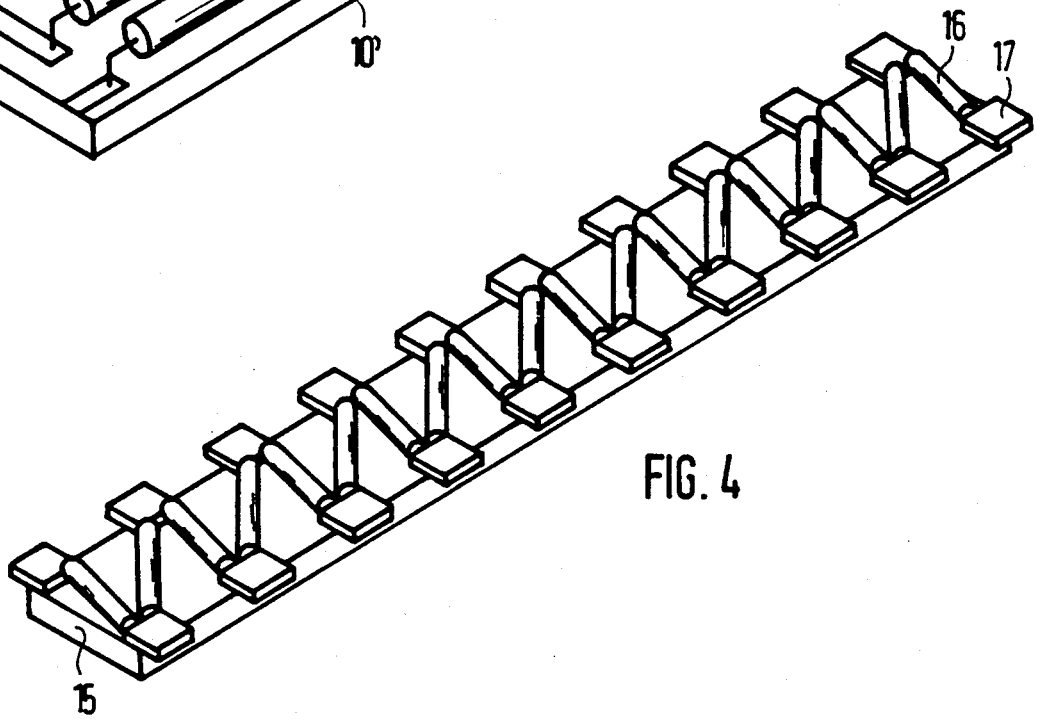
FIG. 4 is a perspective view of a printed circuit board having printed diodes.

FIG. 4 shows a further carrier plate 15 likewise composed of a high dielectric material, for example, of sintered ceramic, on which diodes 16, as doped silicon rods or bands, and contact surfaces 17 are printed thereby forming a diode matrix. This carrier plate 15 with diode matrix is intended for combination with the carrier plate 10, whereby the active surfaces of the carrier plates 10 and 15 are placed on top of one another while soldering the capacitor and diode terminals. As a final step, these double plates 10, 15 can then be cast out with an insulating compound such as synthetic resin.

As already mentioned, the carrier plate 10 is preferably composed of sintered ceramic. The capacitor surfaces can thereby be printed on with, for example, a layout master. The thickness of the carrier plate 10 must be selected such with reference to the capacitors that no punch-throughs arise given a prescribed capacitance, namely dependent on the dielectric strength and on the number of stages of the cascade. When, given a prescribed overall capacitance of the voltage multiplier, a comparatively large number of cascade stages is selected, then a comparatively long carrier plate 10 is required; the thickness thereof, however, can be kept low by contrast whereto the carrier plate 10 can in fact be short given few cascade stages but must then have a comparatively larger thickness. It thus becomes possible to adapt to the particular requirements established by the necessary electrical values and the space present in the spray gun.

The carrier plate 15 for the diode matrix can likewise be composed of sintered ceramic; however, a carrier plate 15 of insulating plastic is also possible because a lower dielectric constant suffices in the carrier plate 15 than in the carrier plate 10 for the capacitors. In this case, too, the two carrier plates 10, 15 are then placed on top of one another, whereby it is inconsequential whether the two carrier plates 10, 15 have their surfaces placed directly against one another or have a minimum spacing from one another because, of course, this component part 10, 15 is ultimately cast out with insulating plastic.

Figure 5:
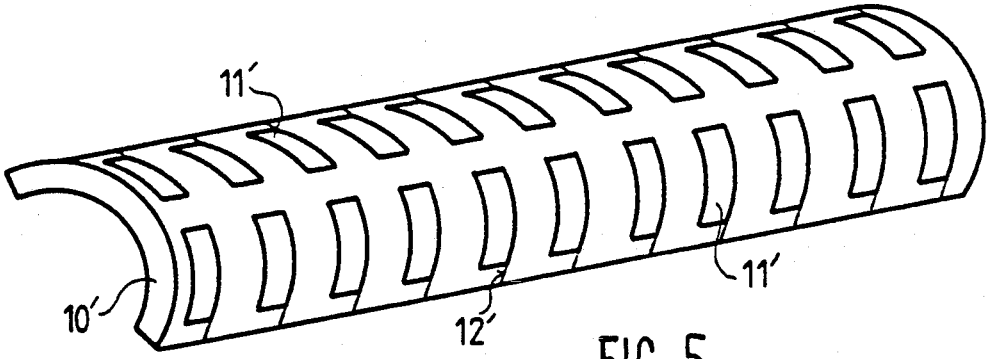
FIG. 5 is a perspective view of a curved carrier plate having printed capacitors.

The diode part, however, can also be constructed and cast out such as known from current, integrated circuits. Another possible modification is comprised in fashioning the carrier plates 10 and/or 15 not as straight rectangular plates but as curved plates such as shown at 10' in FIG. 5, in order to thus take the given mounting conditions within the gun tube into consideration. The guidance of the high-voltage cable can then be arranged in the increased space provided by the curvature. Given curved carrier plates, of course, one must see to it that the printed active regions 11', 12' are respectively of the same size.

When printing interconnects and component surfaces have been referred to above, then what is to be understood by the term "printing" includes known, equivalent application methods such as, for example, vapor deposition and laminating. Additionally, the two carrier plates 10, 15 may be united to form a one-piece ceramic plate that is printed on the basis of thick-film technique with interconnects 12, capacitors and diodes 13.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. In an electrostatic spray gun, for coating workpieces with liquid or powdery coating materials, a voltage multiplier comprising a built-in or attached multistage high-voltage cascade of capacitors and diodes, wherein the high-voltage cascade comprises a carrier plate of material having a high dielectric constant upon which interconnects and capacitor surfaces are printed in a matrix on plate surfaces lying opposite one another and wherein the printed carrier plate is cast out with an insulating compound.

2. A voltage multiplier according to claim 1, wherein the printing of the interconnects and capacitor surfaces comprises vapor deposition.

3. A voltage multiplier according to claim 1, wherein the printing the interconnects and capacitor surfaces comprises lamination.

4. A voltage multiplier according to claim 1, wherein the carrier plate comprises an extension extending beyond the capacitor matrix for the application of other electronic components.

5. A voltage multiplier according to claim 4, wherein said other electronic components comprise resistors.

6. A voltage multiplier according to claim 4, wherein the other electronic components are printed onto the extension.

7. A voltage multiplier according to claim 1, wherein the carrier plate is composed of sintered ceramic.

8. A voltage multiplier according to claim 1, further comprising a second carrier plate onto which a diode matrix corresponding with the capacitor matrix of the first carrier plate is printed whereby the two carrier plates provided with the capacitor matrix and with the diode matrix lie on top of one another and are cast out with insulating material.

9. A voltage multiplier according to claim 8, wherein the second carrier plate is composed of sintered ceramic.

10. A voltage multiplier according to claim 8, wherein the second carrier plate is composed of plastic.

11. A voltage multiplier according to claim 8, wherein the two carrier plates are united to form a one-piece ceramic plate that is printed on the basis of thick-film technique with interconnects capacitors and diodes.

12. A voltage multiplier according to claim 1, wherein the carrier plate is curved.

13. In an electrostatic spray gun, a voltage multiplier having a multi-stage high-voltage cascade of capacitors and diodes, wherein said high-voltage cascade comprises a carrier plate of material having a high dielectric constant with interconnects and capacitor surfaces printed in a matrix thereon, and wherein said printed carrier plate is covered with an insulating compound.

14. A voltage multiplier according to claim 13, wherein the printing of the interconnects and capacitor surfaces comprises vapor deposition.

15. A voltage multiplier according to claim 13, wherein the printing the interconnects and capacitor surfaces comprises lamination.

16. A voltage multiplier according to claim 13, wherein the carrier plate comprises an extension extending beyond the capacitor matrix for the application of other electronic components.

17. A voltage multiplier according to claim 13, further comprising a second carrier plate onto which a diode matrix corresponding with the capacitor matrix of the first carrier plate is printed whereby the two carrier plates provided with the capacitor matrix and with the diode matrix lie on top of one another and are cast out with insulating material.

18. A voltage multiplier according to claim 17, wherein the second carrier plate is composed of plastic.

19. A voltage multiplier according to claim 17, wherein the two carrier plates are united to form a one-piece ceramic plate that is printed on the basis of thick-film technique with interconnects capacitors and diodes.

20. A voltage multiplier according to claim 13, wherein the carrier plate is curved.

* * * * *